US005931562A

United States Patent [19]

Arato

[11] Patent Number: 5,931,562

[45] Date of Patent: Aug. 3, 1999

[54] MULTI-FUNCTIONAL TACTICAL FLASHLIGHT

[76] Inventor: George L. Arato, 62-32 60 Ave., Maspeth, N.Y. 11378

[21] Appl. No.: 08/953,284

[22] Filed: Oct. 17, 1997

[51] Int. Cl.[6] ..... F21L 5/00

[52] U.S. Cl. ..... 362/184; 362/205; 362/276; 362/802

[58] Field of Search ..... 362/184, 276, 362/802, 190, 205, 202, 206, 229, 800

[56] References Cited

U.S. PATENT DOCUMENTS

| | | | |
|---|---|---|---|
| 3,596,078 | 7/1971 | Owens | 362/184 |
| 4,274,130 | 6/1981 | Elliot | 362/184 |
| 4,985,813 | 1/1991 | Putman | 362/184 |
| 5,276,595 | 1/1994 | Patrie | 362/185 |
| 5,359,779 | 11/1994 | Polk et al. | 362/184 |
| 5,645,341 | 7/1997 | Liao | 362/183 |

*Primary Examiner*—Thomas M. Sember

[57] ABSTRACT

A multi-functional tactical flashlight that includes a case, a flashlight bulb, a high intensity flash lamp, at least one infrared sensor, and an indicator. The case has a bulbous head. The flashlight bulb is disposed in the bulbous head of the case and is selectively illuminated therefrom. The high intensity flash lamp is disposed in the bulbous head of the case and is selectively illuminated therefrom. The at least one infrared sensor is disposed adjacent to the bulbous head of the case and is selectively activated. The indicator is responsive to the at least one sensor and indicates when the at least one infrared sensor senses an infrared signal. The at least one infrared sensor can be only one infrared sensor or a matrix array of infrared sensors. The indicator can be only one LED or a buzzer when the at least one infrared sensor is likewise only one infrared sensor or can be a matrix array of LEDs when the at least one infrared sensor is likewise a matrix array of infrared sensors so as to produce a diagrammatic figure of the object being sensed by the matrix array of infrared sensors.

13 Claims, 2 Drawing Sheets

MULTI-FUNCTIONAL TACTICAL FLASHLIGHT

BACKGROUND OF THE INVENTION

1. Field of the Invention

The present invention relates to a flashlight. More particularly, the present invention relates to a multi-functional tactual flashlight.

2. Description of the Prior Art

Numerous innovations for non-lethal self defense devices have been provided in the prior art that will be described. Even though these innovations may be suitable for the specific individual purposes to which they address, however, they differ from the present invention.

FOR EXAMPLE, U.S. Pat. No. 4,186,851 to Cantor teaches a non-lethal personal defense weapon that provides a simultaneous projection of a high intensity beam of light and a concentrated chemical spray designed to immobilize attackers. The weapon features a spray discharge having a range up to 10 feet and embodies a simple, but effective safety, which avoids accidental discharge of the spray. The spray discharge and the light emitting mechanism are controlled by a two-position switch which insures that the high intensity beam of light and the spray discharge may be substantially simultaneously energized.

ANOTHER EXAMPLE, U.S. Pat. No. 4,274,130 to Elliott teaches a combination flashlight and high intensity light source that has a case containing a flashlight bulb, a high intensity flash lamp such as a Xenon flash lamp, and circuit means for selectively engaging the bulb and the lamp to continuously illuminate the bulb and/or flash the lamp. The preferred embodiment is a hand-held self-contained battery powered flashlight having an elongate tubular case with a rear battery comportment for containing dry cells in end-to-end series relation and a front enlarged head portion containing a common reflector for the light bulb and flash lamp and a circuit board mounting the flash lamp flash circuit.

STILL ANOTHER EXAMPLE, U.S. Pat. No. 4,843,336 to Kuo teaches a detachable multi-purpose self-defending device and in particular to one mainly composed of a grip and a barrel. The grip is provided with a high voltage oscillating circuit for supplying a high voltage to the electrodes mounted at the front end of the barrel so as to be able to make the wicked faint temporarily. A pizo siren sends out warning signals to arouse the other's attention to arrest the wicked. A flashlight gives light in the dark, and a strobe light emits rapid, brief and brilliant flashes of light to cause the wicked to lose conscienceness momentarily. Moreover, the grip may connected to a leaf-spring switch which is inserted between the door and the frame so that when the door is opened, the spring leaves thereof will separate from each other hence actuating the pizo siren. In addition, the grip may be connected with a sensor which is designed so that in case the fume concentration and the temperature exceed the rated value, the pizo siren will be actuated to send out a warning signal.

FINALLY, YET ANOTHER EXAMPLE, U.S. Pat. No. 5,549,220 to Whalen teaches a non-lethal, graded method for deterring an assailant by using a hand-held self-defense device which includes an electrical storage battery which acts like a power source, a lamp which emits a directed beam of high-intensity white light, a lamp which emits high-intensity diffuse blue light, a siren, and a source of pressurized chemical repellant. First, an intense beam of white light is directed at the eyes of the assailant, then intermittent high-intensity diffuse blue light and high-intensity sound are simultaneously emitted. If these operations prove inadequate to deter the attack, a spray of chemical repellant is discharged at the eyes of the assailant, using the beam of white light as a guide.

It is apparent that numerous innovations for non-lethal self defense devices have been provided in the prior art that are adapted to be used. Furthermore, even though these innovations may be suitable for the specific individual purposes to which they address, however, they would not be suitable for the purposes of the present invention as heretofore described.

The present invention is to be used by police officers. It works like a regular flashlight and has a flash and an infrared sensor. When searching for a perpetrator, the flash and sensor modes operate. When in a dark place, the flash operates like a camera flash. This way the officer can take a mental picture of the surroundings without becoming a target from a steady beam of light. When the present invention is swept, the sensor will activate when it senses body heat from the perpetrator at that point. The indicator alerts the officer where the perpetrator is, while the flash can be used to affect the eyes of the perpetrator before the regular flashlight is used so that the officer can effect an arrest.

SUMMARY OF THE INVENTION

ACCORDINGLY, AN OBJECT of the present invention is to provide a multi-functional tactual flashlight that avoids the disadvantages of the prior art.

ANOTHER OBJECT of the present invention is to provide a multi-functional tactual flashlight that is simple and inexpensive to manufacture.

STILL ANOTHER OBJECT of the present invention is to provide a multi-functional tactual flashlight that is simple to use.

BRIEFLY STATED, YET ANOTHER OBJECT of the present invention is to provide a multi-functional tactical flashlight that includes a case, a flashlight bulb, a high intensity flash lamp, at least one infrared sensor, and an indicator. The case has a bulbous head. The flashlight bulb is disposed in the bulbous head of the case and is selectively illuminated therefrom. The high intensity flash lamp is disposed in the bulbous head of the case and is selectively illuminated therefrom. The at least one infrared sensor is disposed adjacent to the bulbous head of the case and is selectively activated. The indicator is responsive to the at least one sensor and indicates when the at least one infrared sensor senses an infrared signal. The at least one infrared sensor can be only one infrared sensor or a matrix array of infrared sensors. The indicator can be only one LED or a buzzer when the at least one sensor is likewise only one infrared sensor or can be a matrix array of LEDs when the at least one infrared sensor is likewise a matrix array of infrared sensors so as to produce a diagrammatic figure of the object being sensed by the matrix array of infrared sensors.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 3 is a diagrammatic top plan view taken generally in the direction of ARROW 3 in FIG. 1; and.

LIST OF REFERENCE NUMERALS UTILIZED IN THE DRAWING

Figure 1:
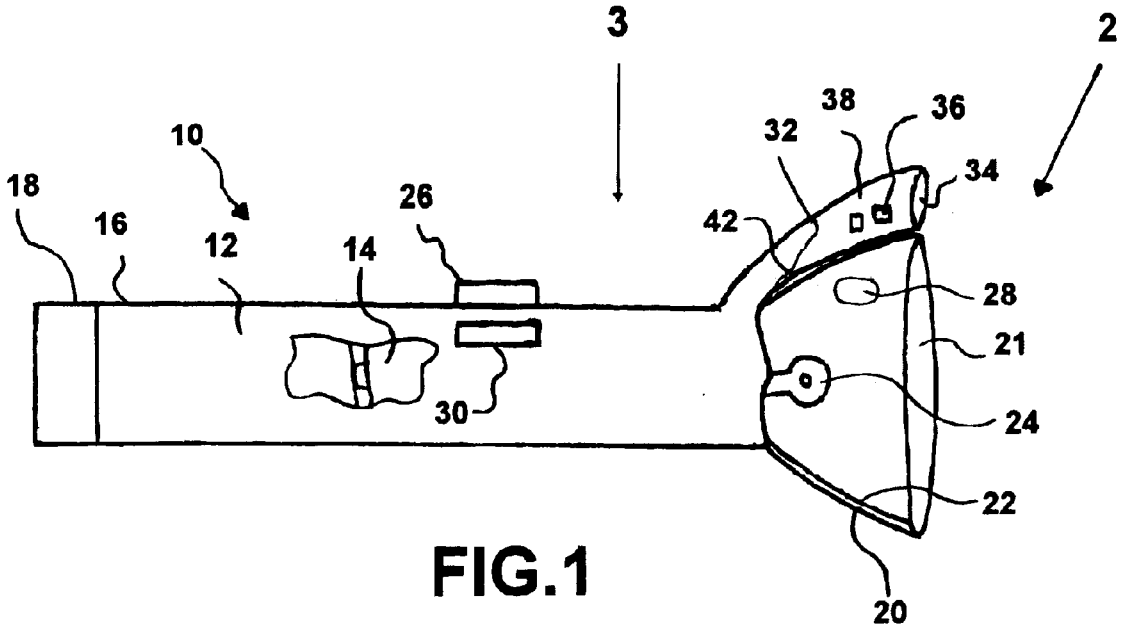
FIG. 1 is a diagrammatic side elevational view of the present invention, with parts broken away.

10 multi-functional tactical flashlight of the present invention
12 case
14 power source contained in case 12
16 threaded tail of case 12
18 end cap for selectively opening and closing threaded tail 16 of case 12
20 bulbous head of case 12
21 first lens for closing bulbous head 20 of case 12
22 reflector in bulbous head 20 of case 12
24 flashlight bulb extending centrally and longitudinally from reflector 22 in bulbous head 20 of case 12
26 first two-position slide switch disposed longitudinally on case 12
28 high intensity flash lamp extending longitudinally from periphery of reflector 22 in bulbous head 20 of case 12
30 second two-position slide switch disposed longitudinally on case 12 adjacent first two-position switch 26
32 pod extending longitudinally forwardly along bulbous head 20 of case 12
34 second lens for closing pod 32 extending longitudinally forwardly along bulbous head 20 of case 12
36 at least one infrared sensor disposed directly behind second lens 34 and contained in pod 32
38 amplifier contained in pod 32
40 third two-position slide switch disposed longitudinally on case 12 adjacent first two-position switch 26
42 indicator extending longitudinally along an exposed surface of pod 32

DETAILED DESCRIPTION OF THE PREFERRED EMBODIMENT

Figure 2:
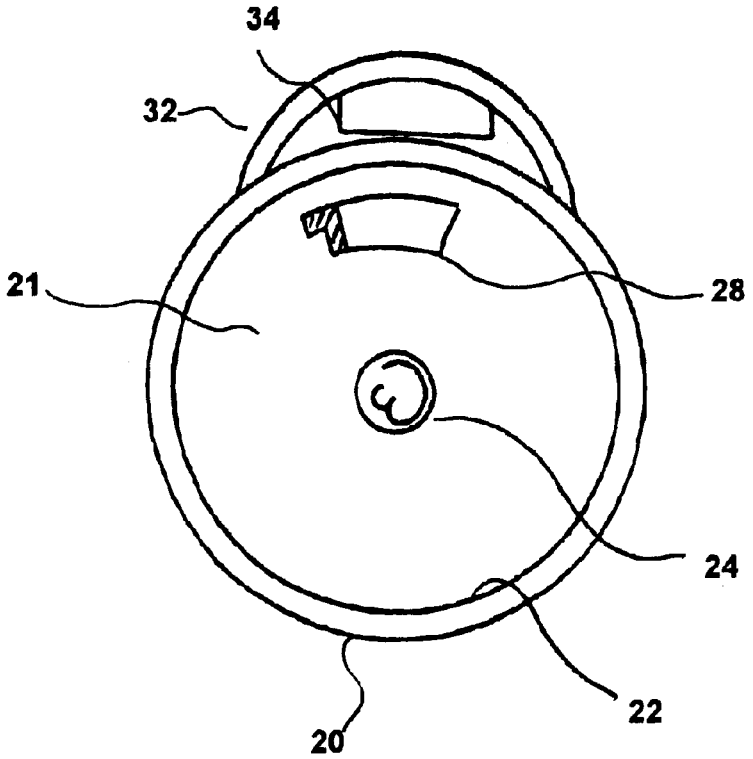
FIG. 2 is an enlarged diagrammatic front end elevational view taken generally in the direction of ARROW 2 in FIG. 1.
Figure 3:
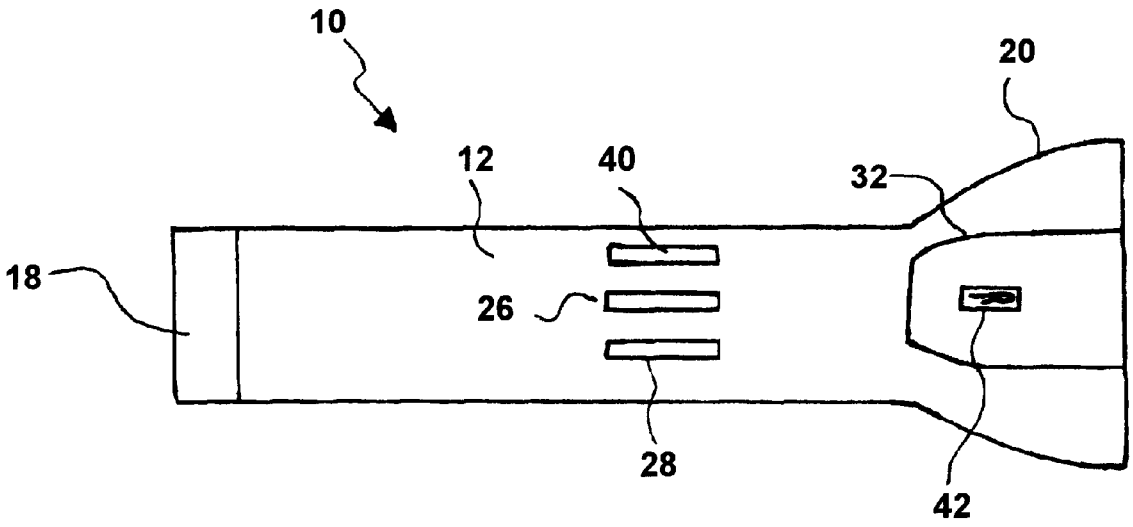
Figure 4:
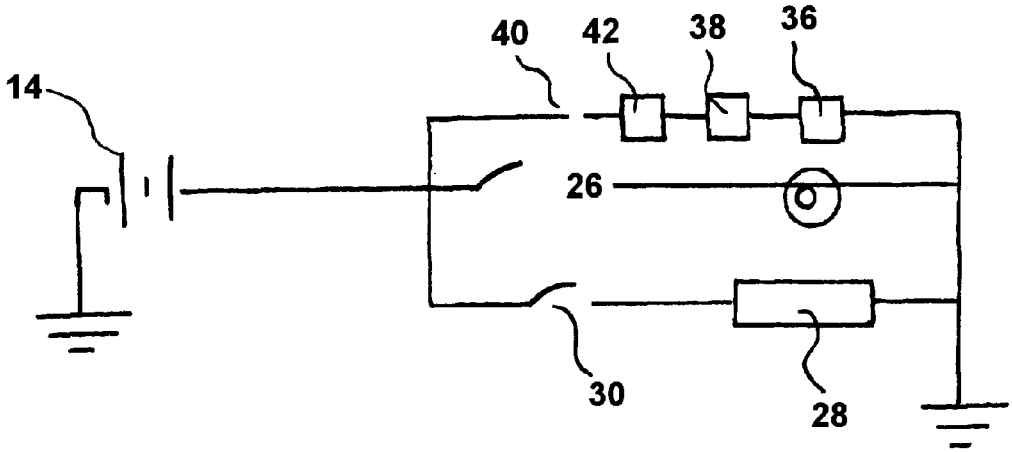
FIG. 4 is a schematic diagram of the circuitry of the present invention.

Referring now to the figures in which like numerals indicate like parts, and particularly to FIGS. 1–4, the multi-functional tactical flashlight of the present invention is shown generally at 10.

The multi-functional tactical flashlight 10 comprises a case 12 that is hand-held and elongated and cylindrically-shaped and contains a power source 14 that is preferably 2 "D" sized batteries.

It is to be understood that the power source 14 is not limited to 2 "D" sized batteries, but can be any power source ample enough to fit in and power the tactical flashlight 10.

The case 12 has a threaded tail 16 that is selectively opened and closed by an end cap 18 for allowing access to the power source 14 when it requires changing.

The case 12 further has a bulbous head 20 that is closed by a firsts lens 21. The bulbous head 20 of the case 12 has a reflector 22 therein with a flashlight bulb 24 extending centrally and longitudinally therefrom. The flashlight bulb 24 is in electrical communication with the power source 14 through a first two-position slide switch 26 disposed longitudinally on the case 12 so as to allow for selective illumination of the flashlight bulb 24 when a flashlight is needed.

The reflector 22 further has a high intensity flash lamp 28 extending longitudinally from its periphery. The high intensity flash lamp 28 is in electrical communication with the power source 14 through a second two-position slide switch 30 disposed longitudinally on the case 12 adjacent the first two-position switch 26 so as to allow for selective illumination of the high intensity flash lamp 28 when needed.

The case 12 further has a pod 32 that extends longitudinally forwardly along the bulbous head 20 of the case 12, where it is closed by a second lens 34. Disposed directly behind the second lens 34, and contained in the pod 32, is at least one infrared sensor 36. The at least one infrared sensor 36 can be a single infrared sensor or a matrix array of infrared sensors, with the second lens 34 focusing light thereon.

The pod 32 contains an amplifier 38 that is in electrical communication with the at least on infrared sensor 36 and the power source 14 through a third two-position slide switch 40 disposed longitudinally on the case 12 adjacent the first two-position switch 26 so as to allow for selective activation of the at least one infrared sensor 36 when needed.

The amplifier 38 is in electrical communication with an indicator 42 that extends longitudinally along an exposed surface of the pod 32. The indicator 42 can be a single LED or a buzzer when the at least one infrared sensor 36 is likewise only one infrared sensor or can be a matrix array of LEDs when the at least one infrared sensor 36 is likewise a matrix array of infrared sensors so as to provide a diagrammatic figure of the object sensed by the matrix array of infrared sensors.

A system for converting an infrared image into a visable or near infrared image is taught by U.S. Pat. No. 5,332,899 to Wolny et al. which is incorporated herein by reference.

It will be understood that each of the elements described above, or two or more together, may also find a useful application in other types of constructions differing from the types described above.

While the invention has been illustrated and described as embodied in a multi-functional tactual flashlight, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multi-functional tactical flashlight, comprising:

a) a case having a bulbous head; said case being elongated and cylindrically-shaped for containing a power source;

b) a flashlight bulb disposed in said bulbous head of said case and being selectively illuminated therefrom;

c) a high intensity flash lamp disposed in said bulbous head of said case and being selectively illuminated therefrom; said high intensity flash lamp being in electrical communication with the power source through a first two-position slide switch disposed longitudinally on said case so as to allow for selective illumination of said high intensity flash lamp when needed;

d) at least one infrared sensor disposed adjacent to said bulbous head of said case and being selectively activated; and e) an indicator responsive to said at least one sensor for indicating when said at least one infrared sensor senses an infrared signal.

2. The flashlight as defined in claim 1, wherein said case has a threaded tail that is selectively opened and closed by an end cap for allowing access to the power source.

3. The flashlight as defined in claim 1, wherein said bulbous head of said case is closed by a first lens.

4. The flashlight as defined in claim 1, wherein said bulbous head of said case has a reflector therein with said flashlight bulb extending centrally and longitudinally therefrom; said reflector has a periphery.

5. The flashlight as defined in claim 4, wherein said reflector further has said high intensity flash lamp extending longitudinally from its periphery.

6. The flashlight as defined in claim 1, wherein said flashlight bulb is in electrical communication with the power source through a second two-position slide switch disposed longitudinally on said case so as to allow for selective illumination of said flashlight bulb when a flashlight is needed.

7. The flashlight as defined in claim 1, wherein said case further has a pod that extends longitudinally forwardly along said bulbous head of said case, where it is closed by a second lens.

8. The flashlight as defined in claim 7, wherein said pod contains said at least one infrared sensor disposed directly behind said second lens.

9. The flashlight as defined in claim 7, wherein said at least one infrared sensor is selected from the group consisting of a single infrared sensor and a matrix array of infrared sensors, with said second lens focusing light thereon.

10. The flashlight as defined in claim 7, wherein said pod contains an amplifier that is in electrical communication with said at least one infrared sensor and the power source through a third two-position slide switch disposed longitudinally on said case so as to allow for selective activation of said at least one infrared sensor when needed.

11. The flashlight as defined in claim 10, wherein said amplifier is in electrical communication with said indicator which extends longitudinally along an exposed surface of said pod.

12. The flashlight as defined in claim 1, wherein said indicator is one of a single LED and a buzzer when said at least one infrared sensor is likewise only one infrared sensor.

13. The flashlight as defined in claim 1, wherein said indicator is a matrix array of LEDs when said at least one infrared sensor is likewise a matrix array of infrared sensors so as to provide a diagrammatic figure of an object sensed by said matrix array of infrared sensors.

* * * * *